United States Patent [19]

Armond et al.

[11] 4,388,792

[45] Jun. 21, 1983

[54] APPARATUS FOR PACKAGING MAGNETIC ARTICLES

[75] Inventors: Joseph A. Armond, River Forest; Gabriel R. Buky; Fred Patrick, both of Chicago, all of Ill.

[73] Assignee: Electro-Matic Products Co., Chicago, Ill.

[21] Appl. No.: 173,977

[22] Filed: Jul. 31, 1980

[51] Int. Cl.[3] ..... B65B 5/10; B65B 63/00

[52] U.S. Cl. ..... 53/236; 53/527; 53/244; 53/250; 414/35; 198/469

[58] Field of Search ..... 53/236, 475, 428, 436, 53/444, 446, 244, 250, 148, 544, 527; 414/35; 198/470, 469, 572, 577

[56] References Cited

U.S. PATENT DOCUMENTS

| | | | |
|---|---|---|---|
| 1,249,613 | 12/1917 | Gamper | 53/236 X |
| 2,581,042 | 1/1952 | Otto | 53/236 X |
| 2,602,942 | 7/1952 | Otto | 53/236 X |
| 2,899,783 | 8/1959 | Otto | 53/236 X |
| 2,996,863 | 8/1961 | Odell | 53/236 |
| 3,087,290 | 4/1963 | Odell | 53/236 X |
| 3,464,537 | 9/1969 | Thull | 198/572 X |
| 3,473,287 | 10/1969 | Littwin | 53/236 X |
| 3,570,210 | 3/1971 | Pinnolis | 53/236 X |
| 3,584,697 | 6/1971 | Danielson et al. | 53/236 X |

FOREIGN PATENT DOCUMENTS

| | | | |
|---|---|---|---|
| 2651315 | 3/1978 | Fed. Rep. of Germany | 53/475 |

*Primary Examiner*—Horace M. Culver

*Attorney, Agent, or Firm*—Paul H. Gallagher

[57] ABSTRACT

A fill belt (conveyor) carries boxes successively to a fill position where the magnetic articles (steel needles) are introduced into each box. They are fed from a vibrating bowl, controlled by a solenoid actuated gate. As the articles approach the box in a spout, they are demagnetized to facilitate flow thereof. As they are placed in the box they are magnetized in the box to align them in proper position. This magnetizing alignment is performed in a series of steps, and they are demagnetized after each step, including the final step when they are in their final condition for use. The quantity of articles in a box is sensed by a Hall generator sensor which utilizes the magnetic field in the articles for producing a control signal. While the articles are being deposited in the box, the spout is reciprocated along the path of the fill belt through the range of the box. A feed conveyor feeds the empty boxes to the fill belt, where a switch controls the travel of the feed conveyor in response to the box being placed on the fill belt. Adjustments can be made for accommodating boxes of different sizes, the box itself by its size controlling the positioning of it at the fill position, and effecting a signal in the Hall generator sensor according to the quantity of articles in the box.

8 Claims, 25 Drawing Figures

Fig. 6.
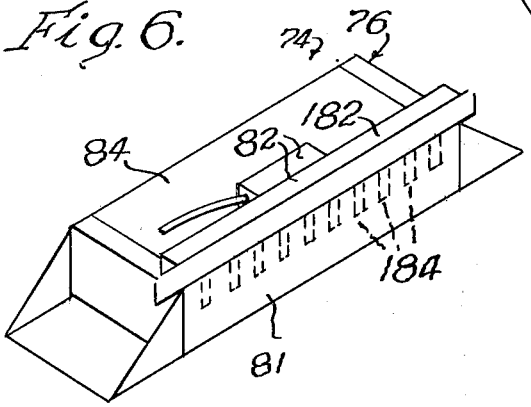
Fig. 7.
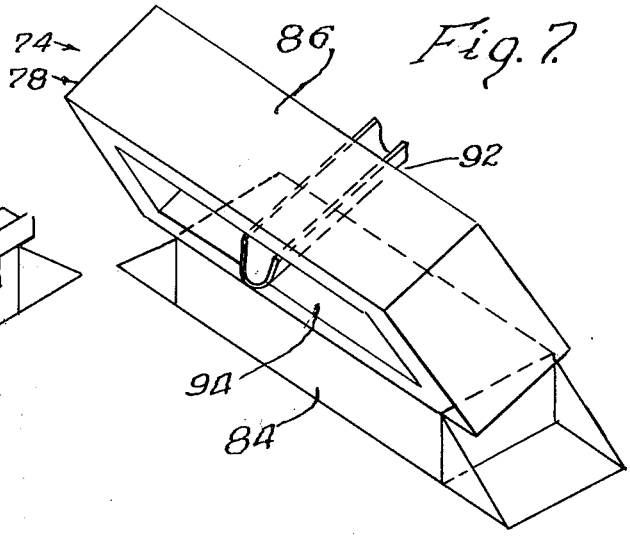
Fig. 8
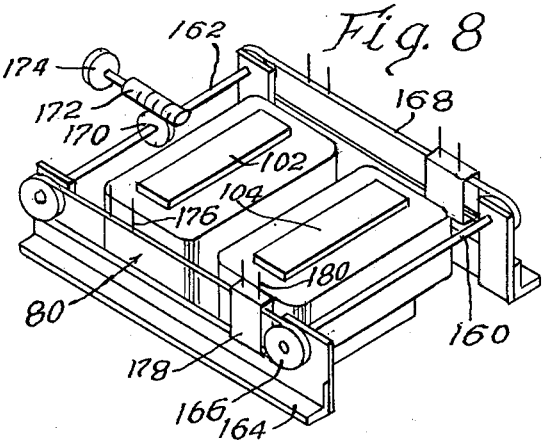
Fig. 10.
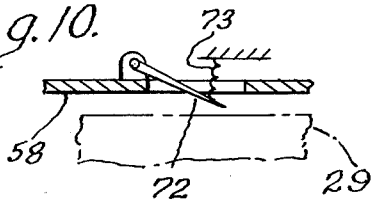
Fig. 9.
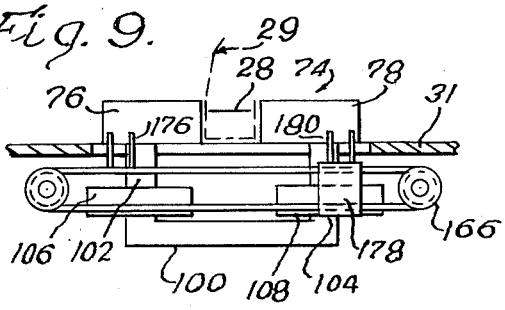
Fig. 11.
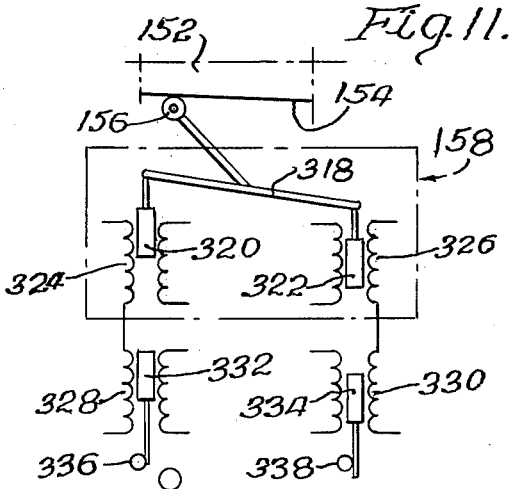
Fig. 13.
| | |
|---|---|
| 14 | 16 |
| 15 | 17 |
Fig. 12.
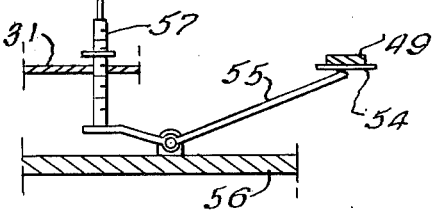

188
189
190
194
192
192
192S
198
196
199
240b
216
202
210b
201
START
241
238b
204
254
252
197
234i
304e
253
344
346
212d
336b
306e
292
298
253
216
239
241
255
212
237
250d
306f
304g
255
262
256
234j
304g
364
314d
310
309
316d
151
316f
197
198
314e
314f
118
316e 34
36
38
40
42
44
46
48
50
52
54
56
58
60
250c
304h
234e
207
198
197
64
66
250a
250
309
11
12
5
3
6
4
255
253
68
310
BOWL FEED
270
307
116
266b
302b
304f
272
138
303
GATE SOL
HOPPER
268
124
301
110
302
348
350
7
2
5
3
255
6
253
4
300
220
218
222
224
226
306d
52
306e
212e
250b
306f
LEGEND:
RECIP. TABLE
MASTER TERMINAL
ELTRONIC STAGE
HALL GENERATOR
8 - 3 3-BARRIER TERMINAL
REACTOR DEMAG. CONTROL + MOT. CONTROL
INDEX TIMER
TRANSFORMER + REACTOR TERMINAL 70
72
74
76
78
80
82
84
86
88
90
92
94
96
98
190
192
254P
254
254S
256
258S
258
255
258P
262
252
248
243
249
246
300
238b
238c
238d
238e
266
240e
240c
240d
240b
106
108
244

100
102
104
106
108
110
112
114
116
118
120
122
124
126
128
198
197
200
203
205
209
210
210a
211
207A
212
212c
214
224
234
234b
234c
234g
234h
235
236
236a
238
240
292r
304
304A
304b
304c
304d
305
306
306b
306c
307
308
308b
308c
308d
308e
309
310
311
312
314
314b
314c
316
316b
316c
39
72
6
8
9
10
11
12
14

APPARATUS FOR PACKAGING MAGNETIC ARTICLES

FIELD OF THE INVENTION

The invention resides in the general field of packaging magnetic articles such for example as steel syringe needles. In the packaging step, the needles are placed in boxes and it is of course desired that the needles be aligned parallel so as to stack properly, but difficulty has always been encountered in so properly aligning the needles. The needles tend to fall in a somewhat haphazard position, out of parallel, because of their movements, and also at least at times partially because of previous incidental magnetic effect. In the production of the needles, certain fabricating steps partially magnetize the needles, and this magnetization adds to the difficulty in properly aligning the needles in the boxes.

OBJECTS OF THE INVENTION

A broad object of the invention is to provide novel apparatus and method for packaging magnetic articles in boxes so as to properly align them in the boxes.

An additional broad object is to provide novel apparatus and method of the foregoing general character incorporating the following features and advantages: (a) Utilizing magnetism for properly aligning the articles in the boxes and utilizing demagnetizing steps for eliminating incidental magnetism previously in the articles, and for controlling movement of the articles into the boxes in the packaging steps, and for ultimately demagnetizing the articles after they are packaged so as to render them in proper condition for use according to their own character.

(b) A novel control arrangement for moving boxes into a fill position in which they are filled, and carrying them away from that position after they are filled.

(c) Utilizing a novel apparatus and method for distributing the articles throughout the volume of the boxes.

(d) Incorporating a novel apparatus and method for producing a reciprocating motion for use in the step of filling the boxes, and utilizing slow and progressive start and stop motions in the reciprocating motion so as to eliminate undesired disturbance of the articles being packaged.

(e) A novel arrangement for sensing the level of the articles in the boxes as the boxes are being filled for controlling the apparatus according to the filled condition of the boxes.

(f) Incorporating novel apparatus and method for sensing the fill level of the articles in the boxes at various levels or stages, and then demagnetizing those articles that had been placed in the boxes in such filling steps for more effectively placing the articles in the boxes in the final filling steps.

(g) Novel apparatus and method for accommodating boxes of different sizes.

(h) Apparatus and method for utilizing both magnetizing and demagnetizing steps according to the foregoing, incorporating a novel arrangement for utilizing the same coils for both magnetizing and demagnetizing step.

DESCRIPTION OF A PREFERRED EMBODIMENT

In the drawings:

FIG. 6 is a perspective view of a component of the apparatus, indicated by the arrow 6 of FIG. 2;

FIG. 7 is a perspective view of a component of the apparatus, indicated by the arrow 6 of FIG. 2;

FIG. 8 is a perspective view of a component for adjusting the components of FIGS. 6 and 7 when assembled in the apparatus;

FIG. 9 is a view of the component of FIG. 8, as incorporated in the apparatus, with other elements, taken at line 9—9 of FIG. 2;

FIG. 10 is a fragmentary detail view taken at line 10—10 of FIG. 5;

FIG. 11 is a semi-diagrammatic view of certain elements shown and indicated in the dot-dash outline 11 of FIG. 4;

FIG. 12 is a view of means for adjusting the fill belt, indicated at 12 in FIG. 3 and oriented according to that figure;

FIG. 13 is a chart showing the arrangement of FIGS. 14–17 which together include a single, main circuit diagram;

Figure 2:
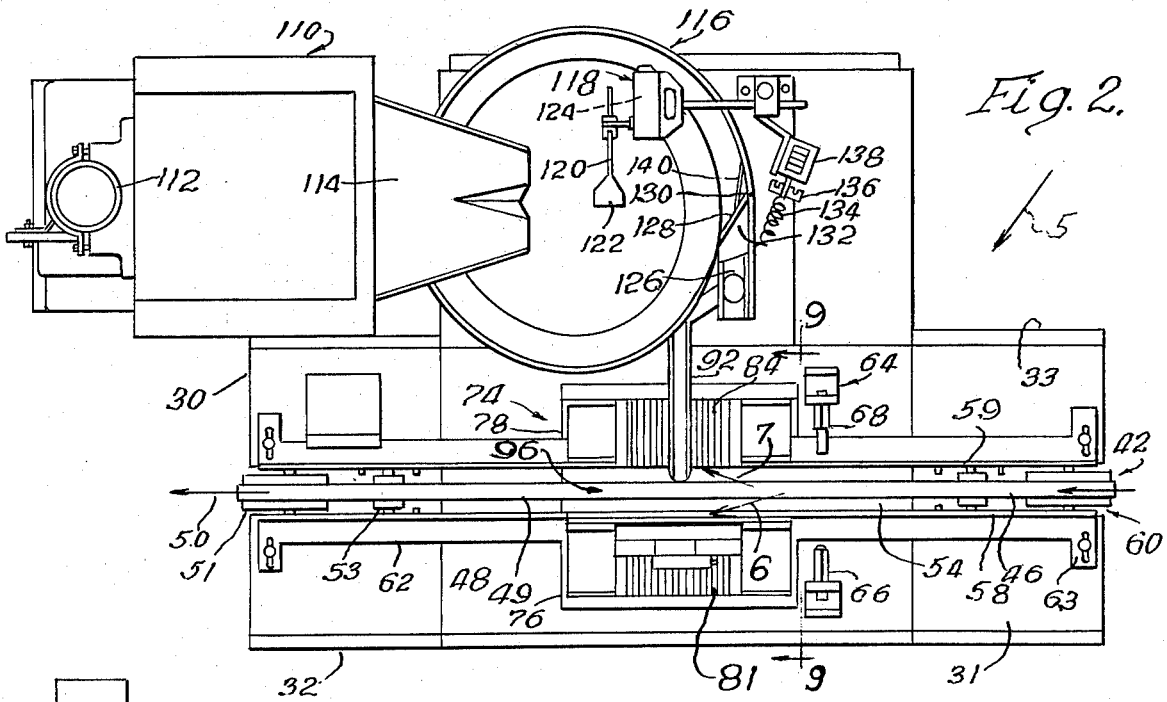
FIG. 2 is a top view of the apparatus.

In the following detailed description, the overall main functioning of the apparatus is first set out, followed by a description of the mechanical structure of the apparatus, and then its specific operation and control by the electrical circuit.

In its overall pattern of functioning, empty boxes are conveyed successively to a fill position, where the articles to be packaged are introduced into the box then in that position. The articles are transferred from a vibrating bowl to the box, and at this step they are demagnetized to remove any magnetism that had previously incidentally been found therein. As they are being placed in the box, they are magnetized in order to align them in parallel and predetermined position in the box. Then they are demagnetized, so as to be free of magnetism for use as intended, such as needles in syringes, in the assumed case.

In demagnetizing articles as it has always been done, magnetizing has been an inherent factor in demagnetizing, and coils used for the purpose are often referred to as magnetizing coils. Further, in the trade magnetizing is sometimes referred to as magging, and demagnetizing as demagging. Accordingly, certain coils are referred to as mag/demag coils.

The articles to be packaged are shown diagrammatically at 28 in a box 29 in FIG. 9. They are put in parallel position, across the short dimension of the box.

The apparatus includes a suitable main frame or stand 30 supporting the remaining components and parts of the apparatus, having a table top 31, and which has a front side 32 and a rear side 33 and, as viewed by a user at the front, a right side 34 and a left side 35. A feed conveyor 38 (FIG. 5) driven by a motor 39 (124) leads from the rear forward, and has a delivery end 40 terminating at a fill conveyor 42, conveying empty boxes 29 to the fill conveyor. For convenience, the feed conveyor 38 has been omitted from FIGS. 1–4.

Figure 1:
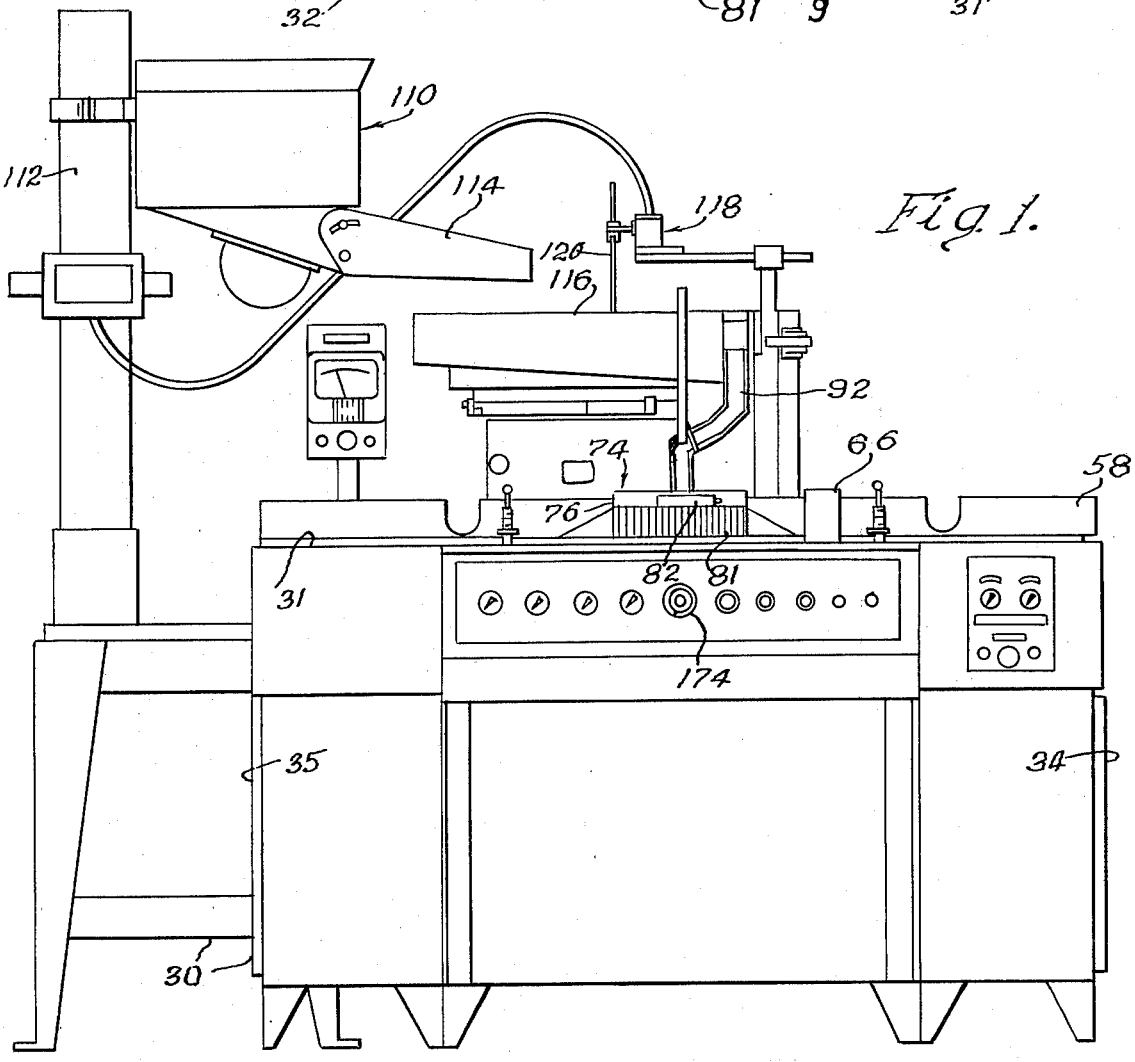
FIG. 1 is a front view of the apparatus of the invention without the feed conveyor.
Figure 4:
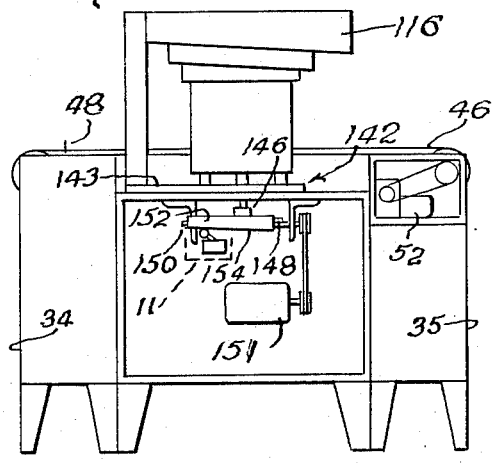
FIG. 4 is a small-scale view of the rear, from which many details have been omitted.

The fill conveyor 42 includes an endless belt 46 provided with cleats 48, its upper run 49 proceeding to the left as viewed in FIGS. 1 and 2 as indicated by the arrow 50. The belt is trained on pulleys 51 one of which is driven by a suitable reversible motor 52 (FIG. 4). Idlers 53 engage the lower run of the belt, and plate 54 (FIGS. 2 and 12) supports the central portion of the upper run. The upper run is adjustable vertically by levers 55 (FIG. 12) at the ends of the plate, pivoted on a frame element 56, the levers being actuated by adjusting knobs 57 threaded in the table top 31.

Side walls or guide elements 58, 59 are provided on opposite sides of the belt 46, forming a channel 60 for confining and guiding the boxes as they are carried by the belt. These side guides are formed by vertical flanges on non-ferrous brackets 62 mounted for lateral adjustment toward and from each other as indicated at 63 for accommodating boxes of different widths as will be referred to again hereinbelow.

Along the progress of the boxes on the belt is PE cell means 64 including a transmitter 66 and a receiver 68. This PE cell means is utilized for controlling travel of the belt 42 in accordance with the presence of a box on the belt, and the timing of its operation, as explained hereinbelow.

The guide rail 59 is provided with a cut-out portion 70 (FIG. 5) in register with the feed conveyor 38 and in the opposite guide rail 58 is a switch 72 (126) which is engaged by a box as it is delivered from the feed conveyor 38 for performing a control operation as described hereinbelow. The switch 72 is biased to normal position by a compression spring 73 (FIG. 10).

A magnetizing and demagnetizing assembly is indicated in its entirety at 74 (FIGS. 1–3) and includes three main components namely, a front unit 76 and a rear unit 78, both above the table top 31, and a transformer 80 below the table top. The front unit 76 includes a bottom set of laminations 81 (see also FIG. 6) forming a pole extension, and a Hall generator sensor 82 fixedly mounted thereon. The rear unit 78 includes a bottom set of lamination 84 (see also FIG. 7) forming a pole extension, and a spout or inlet demagnetizing unit 86 fixedly mounted thereon. The units 76 and 78 are adjustably movable toward and from each other to accommodate different size boxes. Further details of construction of these units, and their functioning, will be referred hereinbelow, but it is pointed out here that the spout demagnetizer unit 86 (see also FIG. 7) is arranged for accommodating a fill spout 92 also described hereinbelow. The spout demagnetizing unit 86 is in the form of an elongated box-like structure having a horizontally elongated slot 94 receiving the lower end of the spout 92 and accommodating the reciprocating movements of the spout therein in the filling operation as referred to hereinbelow.

The units 76, 78 define a fill position 96 therebetween, and it will be understood that the boxes are carried to that position after they are carried to the belt 42 by the feed conveyor 38, and after the filling step, they are carried by the belt to a suitable depository, or other conveyor, etc.

The transformer 80 in the assembly 74 (FIGS. 3 and 9) is positioned within the cabinet and includes a C-shape core 100 having front and rear legs 102, 104 respectively, and coils 106, 108 respectively. The legs 102, 104 extend upwardly and are exposed through the table top and engage, or are closely adjacent to, the pole extensions 81 and 84. The transformer 80 remains in fixed position, while in the adjusting movements of the units 76, 78, the pole extensions 81, 84 remain in effective engagement and magnetic relation to the legs 102, 104.

Mounted on the cabinet is a vibrating hopper 110 of known kind, being supported by a post 112. The hopper has an outlet trough or spout 114 which empties into a vibrating bowl 116 also of known kind. In the packaging operation, the articles or needles are deposited in the hopper and upon vibration of the latter they are transferred to the bowl 116, and upon further operating steps, they are transferred into and through the spout 92 identified above. The articles upon passing through the spout of course pass into the box 29 at the fill position. The hopper 110 and bowl 116 are vibrated in a known manner, and the electrical controls therefor are incorporated in the electrical circuit herein, as referred to again hereinbelow.

The bowl 116 is provided with a fill limit control unit 118 which includes an arm 120 extending down into the bowl where its lower end 122 engages the articles in the bowl and upon the quantity of articles therein increasing, the lever 120 is raised, and upon the articles reaching a predetermined fill limit, the lever 120 actuates a switch 124 in the unit 118 for stopping the transfer of articles from the hopper to the bowl, in a specific electrical control as referred to below.

The bowl 116 has an outlet area 126 from which the spout 92 leads, and a gate 128 is mounted in this outlet area. The gate 128 is in the form of a lever or baffle pivoted at 130 and connected thereto is a link 132 extending through the wall of the bowl and to which is connected a link 134 preferably in the form of a coil spring which in turn is connected to the plunger 136 of the solenoid 138. Upon energization of the solenoid the plunger is retracted and the link 134 is pulled, upwardly as shown in FIG. 2, and that in turn pulls the gate element 128 in a counter-clockwise direction to open position shown in dotted lines and enables the articles to move out and into the spout. A baffle 140 aids in guiding the articles in the desired direction. Upon de-energization of the solenoid, the gate 128 swings to closed position shown, blocking exiting of the needles, baffling them back into the next lower level of the ramp.

The vibrating bowl 116 is mounted on a reciprocating table 142 (FIG. 4) movable transversely as viewed in that figure, in the path of movement along the fill belt 42. Upon movement of the reciprocating table, and the bowl 116, the spout 92 carried by the bowl is correspondingly reciprocated and it moves through the length of the box and distributes the articles therein in the filling step. The reciprocating table includes a control mechanism of the kind covered by U.S. Pat. No. 3,045,165, to Arthur K. Littwin, and put out by Electro-Matic Products Co., Chicago, Ill. The mechanical portion of this reciprocating table, as shown in FIG. 4, includes the base element 143 from which a pin 146 extends downwardly, having a screw follower element 148 operatively engaging a screw threaded shaft 150 driven by the motor 151. Upon rotation of the shaft 150, the table is moved in the corresponding direction, (transversely as viewed in FIG. 4). The table is provided with a control element or "taper bar" 152 (see also FIG. 11) having an inclined surface 154 which engages a cam follower 156 and moves the latter, which in turn actuates a linear signalling device 158 for performing a reversing step, as explained fully in said U.S. patent, and as referred to again hereinbelow.

Reference is made to FIGS. 8 and 9 showing the means for adjusting the units 76 and 78 toward and from each other. It is shown associated with the transformer 80 for convenience in orientation. The device includes a rear or inner shaft 160 and a front or outer shaft 162 suitably mounted in brackets 164 mounted in the frame of the machine. Mounted on the shafts are sprockets or pulleys 166 on which are trained chains or belts 168. On the outer shaft 162 is a worm gear 170 which is engaged by a worm 172 on a shaft extending to the exterior of the apparatus on which is a control knob 174, this control knob being shown in FIG. 1 at the center of the main control panel. Mounted on the upper run of the chains 168 are pins 176 and secured to the lower run are boxes or brackets 178 on which are pins 180 extending upwardly. Upon rotation of the shafts 160, 162, the chains 168 are driven, and the respective pins, 176, 180 move toward or from each other depending on the direction of movement of the chains. These pins are connected with the units 76 and 78 and correspondingly adjustably move those units toward and from each other as referred to above. The legs 102, 104 extend through the table top 31 and engage the pole extension 80, 84, forming extensions or continuations of the legs 102, 104, as indicated above, forming a gap between them in the fill position and containing the articles in the box at that position.

The Hall generator sensor 82 is shown also in FIG. 6 in addition to FIGS. 1 and 2. This unit has a main body 182 extending substantially the length of the unit 81, and thus throughout the length of the longest of the boxes to be filled. As is known, a Hall generator is responsive to a magnetic condition, specifically, generating voltage thereon when in a magnetic field, and increasingly so as the field increases. This unit 82 is incorporated in the electrical circuit herein and will be referred to again hereinbelow, but it includes a plurality of individual units 184, FIGS. 6 and 24, facing or directed toward the fill position, and they thus are directly affected by the level of the magnetic field in the articles in the box. The value of this magnetic field is utilized for producing a desired control function in the electrical circuit as referred to hereinbelow.

In the electrical circuitry, of FIGS. 14–17, the diagrams are provided with line numbers at the left margins thereof to facilitate designating the locations of various elements referred to, those line numbers being given in parenthesis following the references in the specification to the corresponding elements.

In the identification of transformers and the coils thereof, the transformers as a whole are designated with principal reference numerals, and the primary and secondary coils with the same reference numerals with postscripts P and S respectively. Similarly, in the case of relays, the relays as a whole are designated with the principal reference numerals, while the coils thereof are designated with the same reference numerals and the postscript a and the contacts also with the same reference numerals, but with the postscripts b, c, d, etc.

Attention is directed to the main electrical circuit of FIGS. 14–17, to be placed together as indicated in FIG. 13. For the most part the description of the main circuit will be done with respect to the specific operation and function of the particular parts of the mechanical apparatus. A suitable AC source is indicated at 188 (1) having switch means 189, and conductors 190, 192 leading to a power transformer 194 (2). Leading from the secondary 194S (2) are conductors 196, 198, the former leading through contacts **210*b* (4) to a continuation conductor 197. These conductors 197, 198 lead through FIG. 15 and supply the current thereto, and continue to FIG. 17 (126, 122) where they supply the power to the circuitry of FIG. 17, which is a DC sub-circuit including a rectifier 200**.

To initiate operation of the apparatus, the operator closes the START switch 201 (4) which completes circuit through the conductors 196, 199, 204 and 197. A conductor 202 includes a signal light 216. Leading from the outlet of the rectifier 200 (102) are conductors 203, 205, and these conductors are immediately put in circuit. The relay 210 (103) is thereby energized which closes holding contacts **210*b* (4) and the circuit thus remains energized for further control and operation. The relay 210 is in a conductor 209 (103) which also includes a STOP switch 211**.

Also energized from the conductors 203, 205 is a relay 212 (121) controlled by an output timer circuit 214 (118). This relay 212 also appears at (19) and the output timer control (118) is incorporated in a box index timer 216 (19). This timer is utilized in controlling the movement of the fill belt 42 in carrying the empty boxes to the fill position, and the filled boxes from that position to the outlet of the apparatus.

Connected across the conductors 197, 198 (53) which remain in circuit, is a conductor 218 (53) including a control coil 220, connected with which is an adjustable contact 222 leading to a rectifier 224, the other side of the rectifier being connected with the conductor 198. The rectifier 224 is included in a circuit unit 226 (57) which includes the motor 52 for driving the fill belt 46 (FIG. 4). Various steps in the operation are controlled by the relay 212 (19) and the associated index timer.

Figure 18:
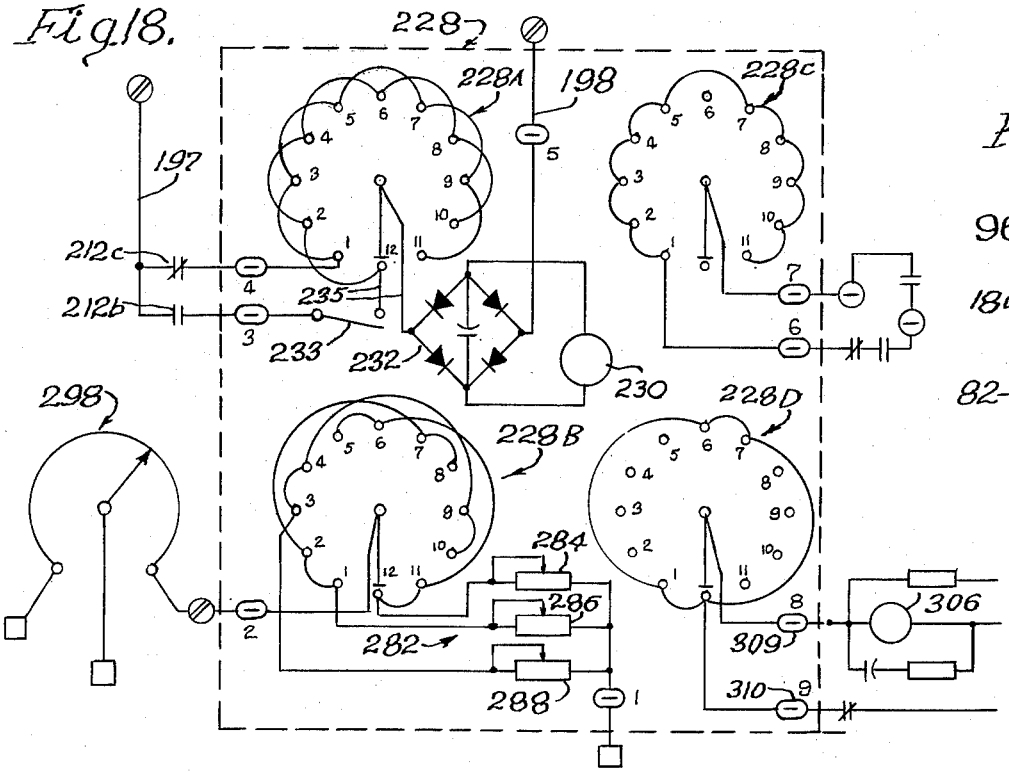
FIG. 18 is an electrical diagram of a stepping switch and related elements.

Associated with this phase of the operation and electrical control, is a stepping switch 228 of FIG. 18, connected across the conductors 197, 198 (5). This stepping switch, of known kind includes four wafers 228A, 228B, 228C and 228D, the switch being driven by a rotor 230 under the control of a rectifier 232. Included in the switch 228 is a switch 233, and conductors 235 between the switch and rectifier. The stepping switch when inactive reposes at position #12 and advances clockwise upon stepping actuation thereof, in a known manner.

Upon energization of the relay 212 (19) the contacts 212*b* (FIG. 18) are closed, energizing the rotor 230 and advancing the stepping switch to position #1.

The index timer 216 (19) is pre-set and the relay 212 (19) times out according to the setting of the timer. Upon this happening, the contacts 212*b* (FIG. 18) open, but the contacts 212*c*, close, while the switch is at position #1, and the switch is advanced to position #2.

Figure 19:
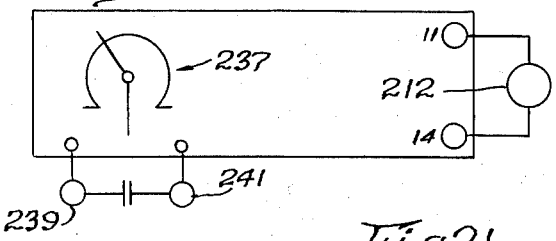
FIG. 19 is a diagram of a detail of the main electrical circuit.
Figure 20:
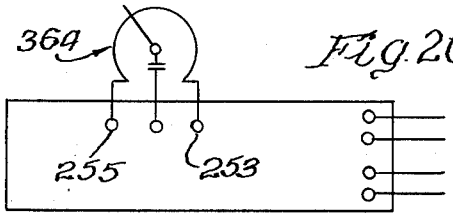
FIG. 20 is a diagram of a detail of the main electrical circuit.

FIG. 19 shows a detail connecting the timer 237 (20).

Energization of the relay 212 (19) closes contacts 212*c* (105) energizing relay 234, as well as 236 (106). The relay 234 closes holding contact 234*b* (105) and also contacts 234*c* (114) energizing relays 238, 240. The latter relays close contacts 238*b*, 240*b* (2) energizing the spout demagnetizing coil 241 (2) in the unit 86, (FIG. 7). Accordingly that demagnetizing coil remains energized during all steps of feeding the articles to the box.

Figure 16:
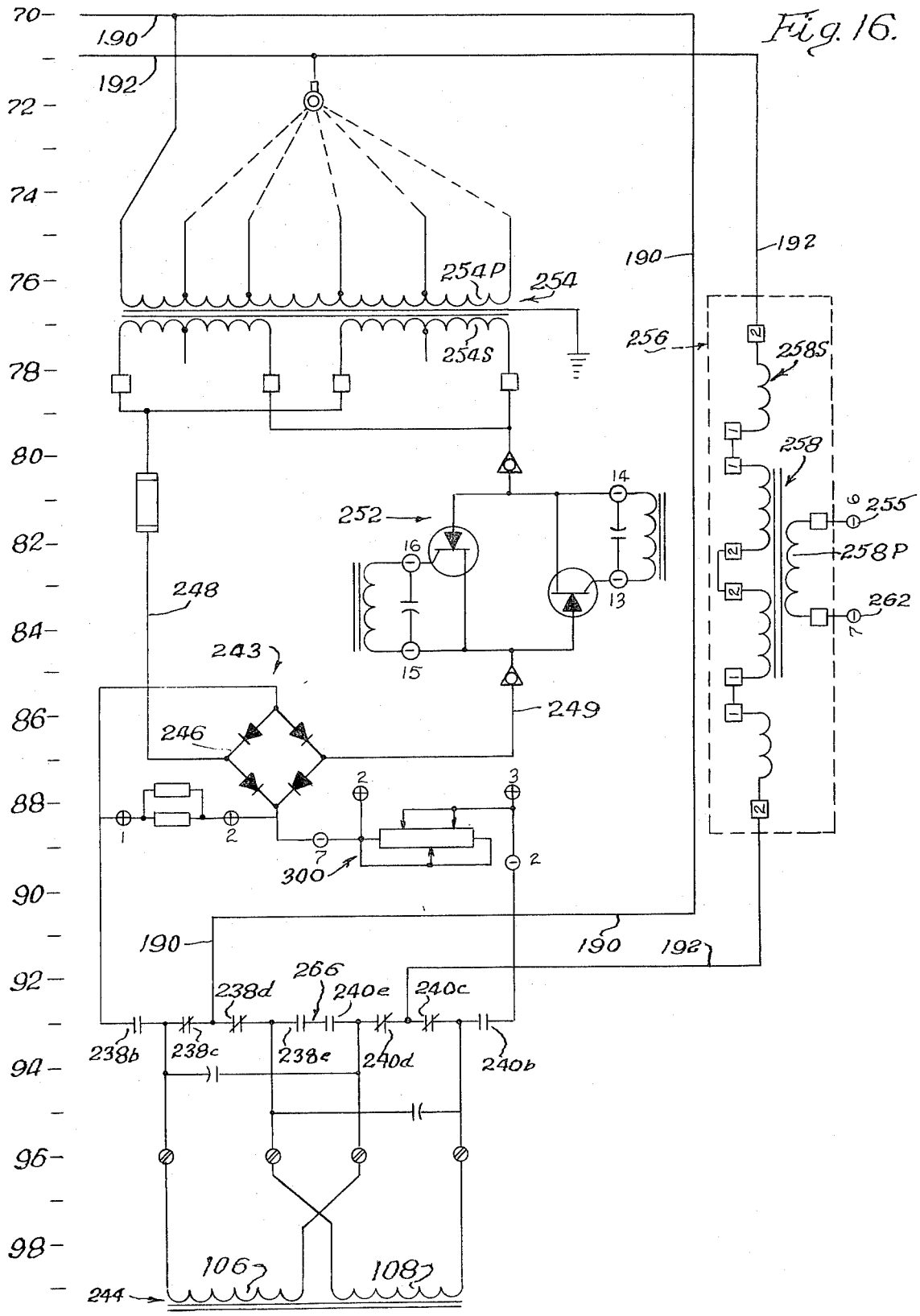
FIG. 16 shows the portion of the electrical circuit, indicated in FIG. 13.
Figure 17:
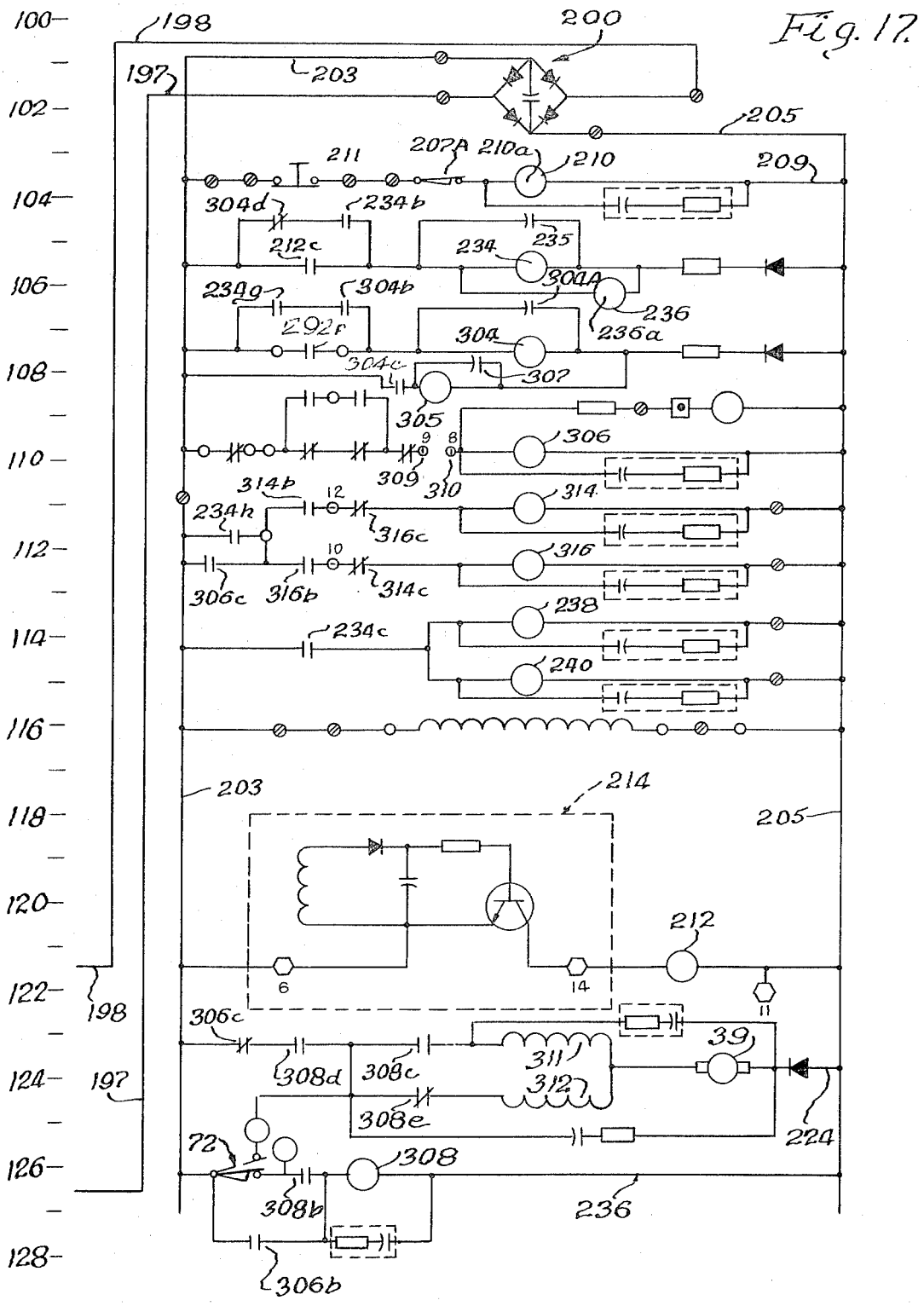
FIG. 17 shows the portion of the electrical circuit indicated in FIG. 13.

Incorporated in FIG. 16 is a DC sub-circuit 243 (84) which includes a magnetic aligning assembly 244 (99) made up of the coils 106, 108 (FIGS. 3 and 9), these coils being put in circuit upon energization of the relays 238 (113) and 240 (115) through contacts 238*b*, 239*e*, 240*b*, 240*e* (93). At this point, DC is impressed on the assembly 244 from the rectifier 246 (87). The rectifier is fed from conductors 248 (84) and 249 (86) the latter including a gate control 252 including a manual control 253 (7). The conductors 248, 249 lead from a secondary 254S of a transformer 254 which itself is fed from the conductors 190, 192 (1).

The coils 106, 108 (99), as explained above, are disposed on opposite sides (FIGS. 2, 3 and 9) of the channel 60 containing the fill belt, and on opposite sides of the fill position, and while they are energized they impress a field on the articles in the box at that position through the pole extensions 81, 84. While they are energized with DC, they impose a steady magnetic field on the articles and magnetize them and align them transversely across the short dimension of the box, all parallel.

These same coils 106, 108 (99) are used also in a demagnetizing step as referred to again hereinbelow. In this demagnetizing step, AC is impressed on them, which is gradually diminished, producing a demagnetizing effect on the articles in the box. This magnetizing and demagnetizing effect (also known as magging and demagging effect) is produced in a series of levels (three in the present instance) as will be referred to again hereinbelow. Certain elements of the apparatus are used both in magnetizing and demagnetizing, and that part of the apparatus that performs these two functions will be referred to, for convenience, as "magnetizing/demagnetizing" means, this means having three components for performing specific magnetizing and demagnetizing steps.

Figure 21:
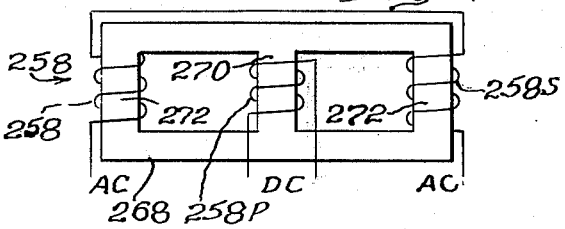
FIG. 21 is a detail view of a transformer used in the demagnetizing step.

Changing from the magnetizing to the demagnetizing effect is under the control of the Hall sensor 82 identified above, in a manner referred to more fully hereinbelow. For the demagnetizing step, a saturable reactor assembly 256 (77, 23) is provided. This unit includes a transformer construction 258 (86) (FIG. 21), the control winding 258P of which derives its source from terminals 255, 262 (22), and controlled in a manner referred to again hereinbelow. The secondary 258S (77) is in the conductor 192 (71) which continues to the conductor 192 (93).

The transformer construction 258 (77) is of known kind, having (FIG. 21) a core 268 with the primary 258P coiled on the center leg 270, and the secondary 258S coiled on two end legs 272. While DC is impressed in the primary coil, AC is enabled to pass through the core, but while the primary is de-energized, AC is impeded from passing therethrough.

In the demagnetizing step, upon energization of the relay 238 (114), 240 (115), control of the contacts (93) is as follows: 238*b* and 238*e* are closed while 238*c*, 238*d* are open and, 240*b*, 240*e* are closed while 240*c* and 240*d* are open. Thus a circuit is established through the coils 106, 108 and the rectifier 246 (87).

While the relays 238, 240 are de-energized, the contacts at (93) are as shown, and a circuit is established through the coils 106, 108 (99) and through the saturable reactor 256 (77) from the input lines 190, 192.

In the demagnetizing step, the primary 258P is energized and AC flows to the coils 106, 108 (99), and the voltage on the primary 258P is gradually reduced under the control of 256 at (23) and as it is so reduced, the AC flowing to the coils 106, 108 is also gradually reduced, with the desired demagnetizing effect.

Figure 22:
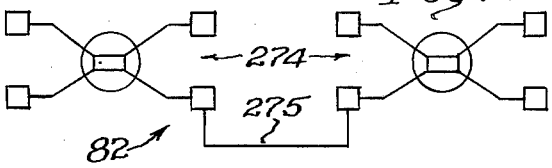
FIG. 22 is a detail showing the arrangement of the elements in the Hall sensor.

Reference is made next to the Hall sensor (FIGS. 1, 2, 6, 22 and 23) which as noted above is incorporated in the component 82 FIG. 6, and thereby at the fill position. As is known, a Hall generator is responsive to a magnetic field, generating increased voltage in response to increased magnetic field. The Hall sensor includes in the present instance, ten of the units 184 (FIGS. 6, 24) and these are distributed along the unit throughout the length of the maximum size box to be encountered, and thus the full length of the mass of articles therein. The elements 184 are connected in series at 175 (FIG. 22) for an additive effect of the total voltage of all of them.

Figure 23:
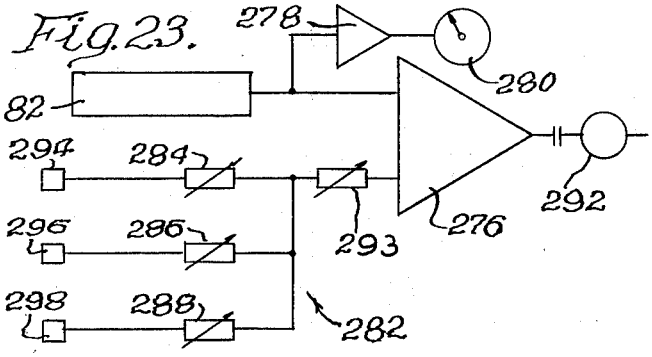
FIG. 23 is a detail of an electrical component including the Hall sensor.

The Hall sensor 82 is incorporated in a circuit detail as shown in FIG. 23, where the output therefrom is conducted to a comparator 276 and to an amplifier 278, the latter leading to a meter 280 reading the level from the Hall sensor. The output from the Hall sensor is compared to a reference voltage established by a component 282 which includes a plurality (three) of adjustable resistors 284, 286, 288 of successively increasing values, the output through these resistors being conducted through a common adjustble resistor 298 (see also FIG. 18) leading to the comparator 276. The comparison voltage is then transmitted to a relay 292 (16). The component 282 appears in FIG. 18 at wafer 228B and the resistors 284, 286 288 are connected with respective terminal on the stepping switch. A manually settable dial 298, FIG. 18 and (16) is provided for setting the overall voltage according to the size of box and quantity of articles therein.

Figure 24:
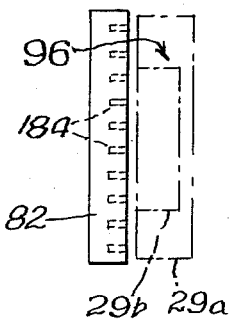
FIG. 24 is a detail view showing the effect of different sized boxes at the fill position, in relation to the Hall sensor.

FIG. 24 is oriented as looking down on the Hall sensor, according to FIG. 2; it extends throughout the fill position 96, and a large box 29*a* (FIG. 24) extends substantially throughout the length of the ten elements 184; this figure shows a smaller box 29*b* of a size arbitrarily selected, extending throughout the range of six of those elements. Accordingly a greater mass of articles are found in a bigger box in a similar set of circumstances than in a smaller box, and correspondingly larger and smaller current is conveyed through the Hall sensor. This greater or lesser current is taken into account in the setting of the dial 298 (FIG. 18) (16) for controlling the relay 292 (16) according to the levels of articles in the box.

Energization of the relay 234 (105) also closes contacts 234*i* (7) which puts into circuit the DC control (7), which is manually set at 253 (7), for the purpose of varying the magnetic alignment level, that is, different DC voltage applied to the magnets 106, 108 (99) according to the characteristics of the articles, which might be the mass of the articles, the gaps between them, or anything that would affect the alignment by magnetization. The contacts 234*i* (7) specifically activate the firing circuit 252 (83). In this step, i.e., magnetizing the articles by energizing the coils 106, 108 (99), the current through the adjustable resister 300 (52) is sensed, and it energizes relay 302 (49). This closes the contacts 302*b* (42) and energizes the gate solenoid 138 (42) identified above, in FIG. 2, enabling the articles to progress down the spout. This also turns on a box filling light 303 (41).

Additionally the closure of the contacts 302*b* (42) energizes a hopper solenoid 301 (44) for vibrating the hopper 110. The hopper is controlled by the bowl fill limit switch 124 (43) referred to above, incorporated in the unit 118 (FIGS. 1 and 2). When the level of articles in the bowl rises to the desired limit, the switch 124 is opened under the action of the lever arm 120.

In this action also, the bowl is vibrated by a solenoid 307 (40) while it is otherwise enabled as referred to again hereinbelow.

While the relay 292 (16) is energized, as referred to above, the contacts 292*b* (108) are closed, and the relay 304 (107) is energized, itself energizing holding contacts 304*b* (107), and upon otherwise energization of the relay 234 and the closure of the contacts 234*g* (106) a holding circuit is established in the relay 304. Energization of the relay 304 closes contacts 304*c* (108) energizing relay 305. The relay 306 (110) is energized upon connection between the terminals 309, 310 (110), and energization of the relay 306 closes contacts 306*b* (128).

Figure 5:
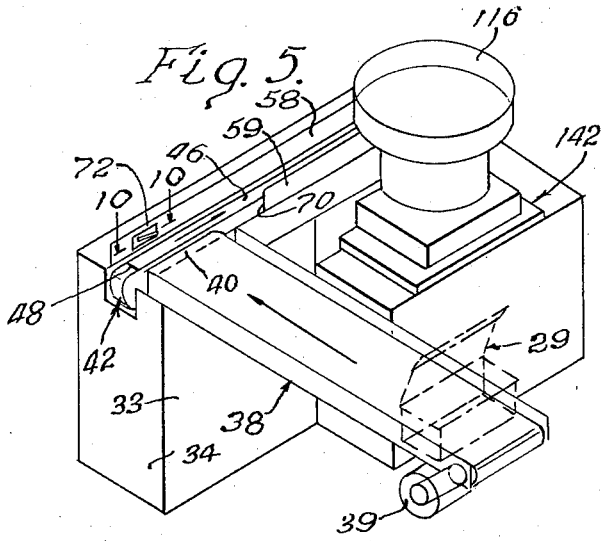
FIG. 5 is a small-scale perspective view taken from an elevated position and at an angle indicated by the arrow 5 in FIG. 2 but with the feed conveyor added.
Figure 14:
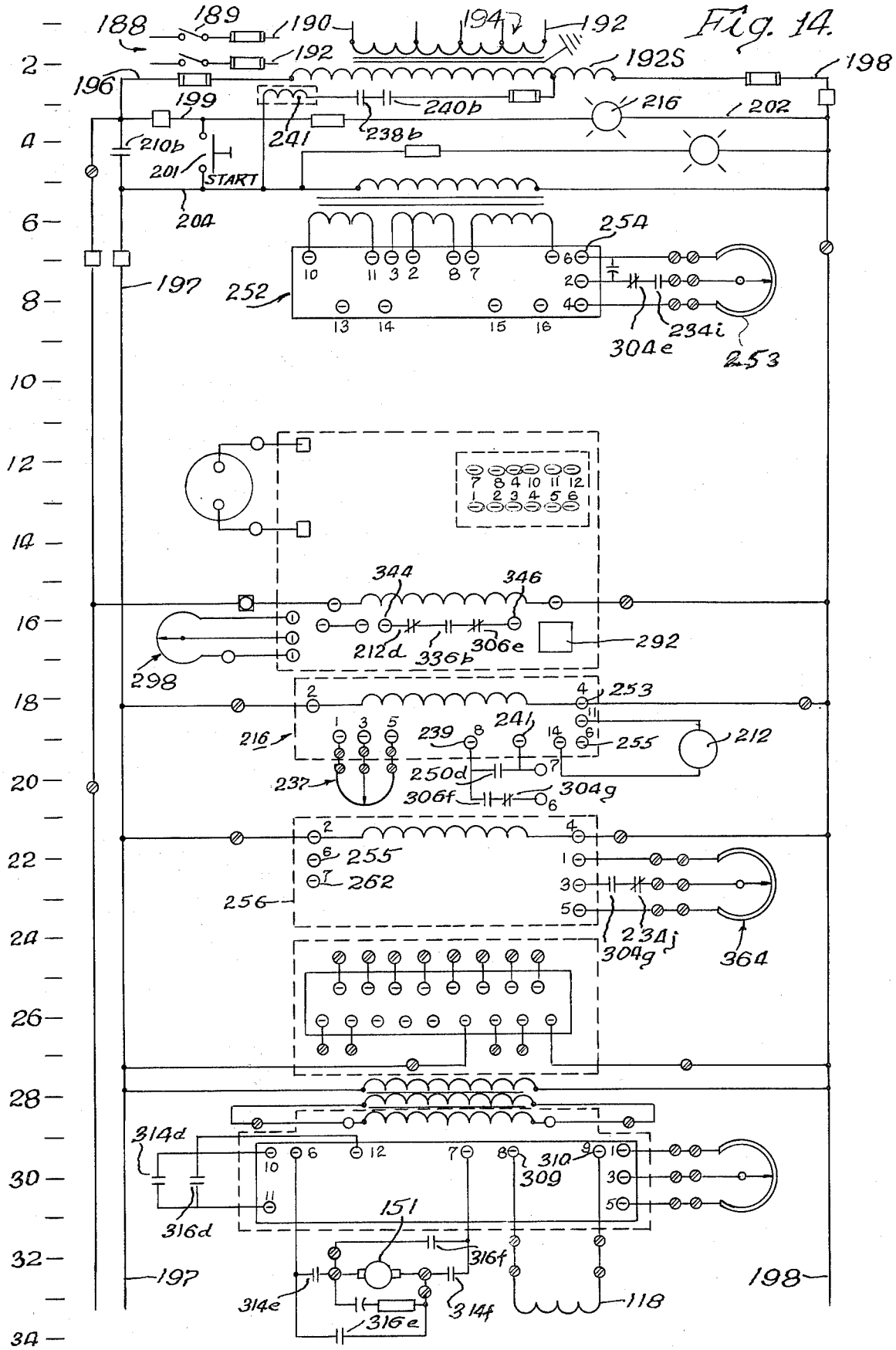
FIG. 14 shows the portion of the electrical circuit, indicated in FIG. 13.
Figure 15:
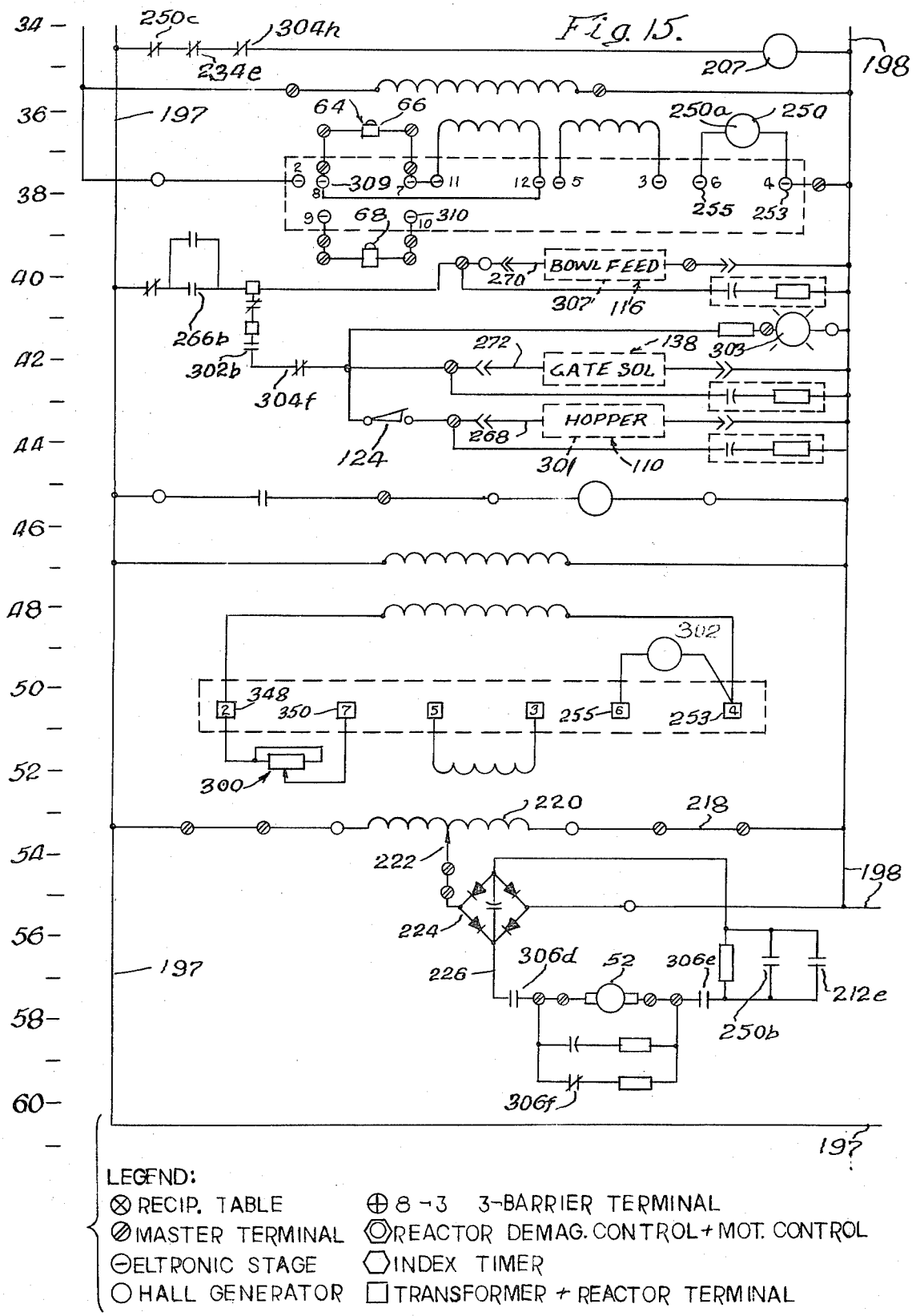
FIG. 15 shows the portion of the electrical circuit indicated in FIG. 13.

The contacts 306*b* (128) closes circuit to the relay 308 (126) which closes holding contacts 308*b*. The relay 308 additionally closes contacts 308*c* and 308*d* (123). A circuit is thereby established through the forward field 311 (123) of the feed motor 39 (124), FIG. 5. This conveyor carries the box to the fill belt (FIG. 5) until it engages the switch 72 which is shown also at (126). The box moves the switch to its alternate dotted line position, which then establishes a circuit through the reverse field 312 (124) and reverses the motor 39 and conveyor 38. This reversal is only momentary, the switch being biased back into position by the spring 73 (FIG. 10) and the box is free to fall on the belt 46 (FIG. 5). Upon the switch resuming its normal position (126) the motor 39 is enabled and the conveyor is, again, ready to carry another box to the belt 46, when 306*b* (128) signals.

Figure 3:
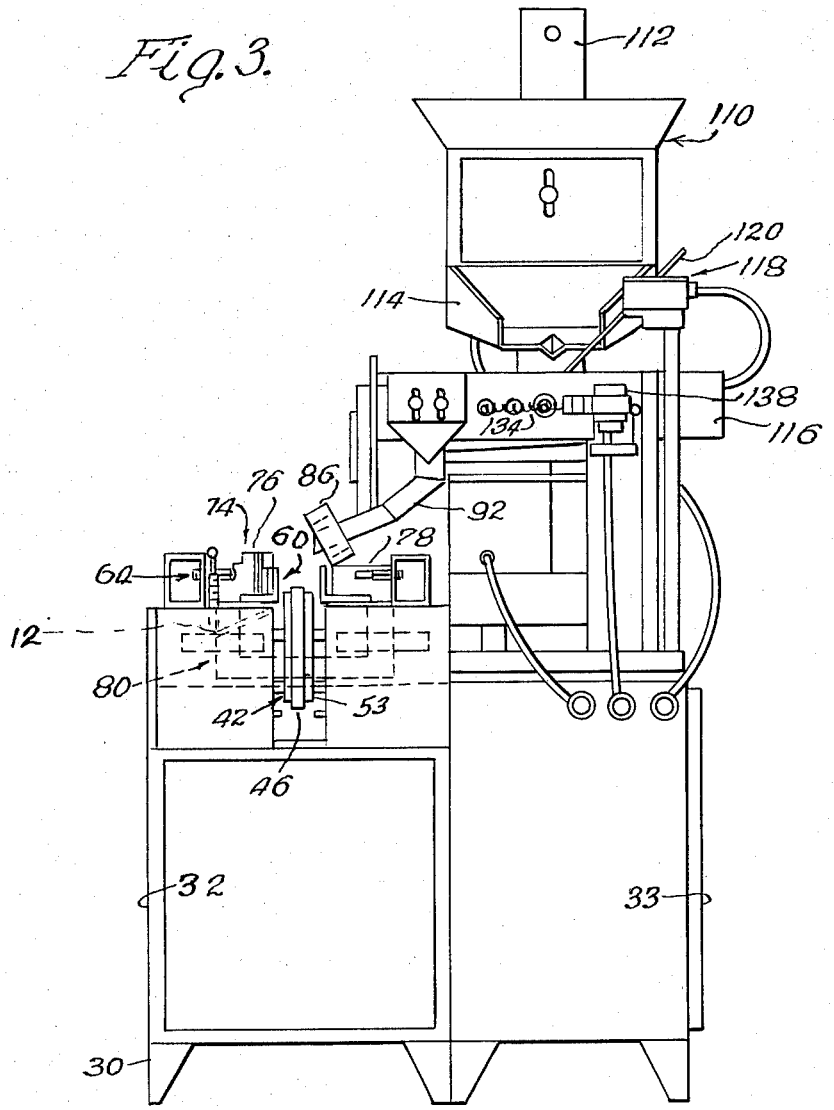
FIG. 3 is an end view, taken from the right of FIG. 1.

In the control of the feed conveyor 38 as just referred to, the relay 306 (110) closes contacts 306*d*, 306*e* (57) establishing drive of the belt motor 52 (57) FIGS. 1–3, and opens contacts 306*f* (60) closing a dynamic braking circuit to the motor. The control of the reciprocating table 142 (FIG. 4) includes a relay 314 (111) and a relay 316 (112). These are themselves controlled by the relay 234 (105) which closes contacts 234*h* (112) conditioning the relay 314 for energization. The relay 306 (108) closed contacts 306*c* (112) which conditions relays 316 for energization. The movement of the table in one direction closes contacts for switching the circuit for reversing the table. Attention is directed to FIG. 11 which shows a control for this purpose, indicated in the rectangle 11 in FIG. 4. The taper bar 152 through its inclined edge 154 engages the cam follower 156 which rocks a bar 318 having armatures 320, 322 on the ends which work in coils 324 and 326. These coils are operatively connected with related coils 328, 330 in which are armatures 332, 334 actuated by manual knobs 336 and 338. As pointed out in U.S. Pat. No. 3,045,165 referred to above, upon setting the armatures 334, 332, control signals are produced by the armatures 320, 322 upon rocking thereof, pursuant to reciprocation of the table, for reversing the table. This reversing control is accomplished through 314*b* (111) and 316*b* (112). It will been seen therefore that as the table approaches the end of its movement in each direction, it closes the related contacts 316*b*, 314*b* and upon de-energization of the corresponding relay, the other contacts 314*c* and 316*c* are opened. Manual adjustment of the armatures 332, 334 controls the development of the signals according to the position of the table, for controlling its range of movement. The control knobs 336, 338 are individually adjustable for adjusting the limits of each end of the movement of the table.

The motor 151 for driving the reciprocating table and the contacts 314*d*, 316*d* are shown at (30). The reversing contacts 316*c* (111) are found also at (32) and are associated with contacts 316*e* (34); similarly the contacts 314*c* (112) are found at (32) and associated contacts 314*e* (32) cooperating therewith.

Figure 25:
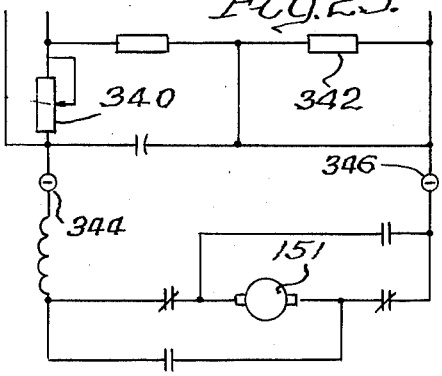
FIG. 25 is a detail of an electrical component for controlling the reciprocable table.

Provision is made for gradually starting and stopping the reciprocating table motor 151 so as to eliminate shock in the movement of the table. This is represented in FIG. 25 where the circitry shows an element 340 producing armature feedback current, and a voltage feedback element 342, whereby the reversing contacts are closed for reversing the table before the table reaches the end of its movement in the corresponding direction providing a cushioning stopping movement, and the voltage applied to the motor at the beginning of the succeeding movement is reduced and gradually increased, whereby to gradually increase the speed of the table in the opposite direction. This occurs at both ends of the table.

In the step of filling the box, and the action of the Hall sensor, attention is directed to (16) contacts 212*d*, 236*b*, 306*e*, which are between terminals 344, 346 which are also shown in FIG. 25. When these contacts are closed, relay 292 (16) is conditioned for energization. Relay 292 is energized when the box is filled to a predetermined level according to the levels indicated at FIG. 23. The same function is repeated at each of the levels, namely, the first, second and third, the third being the final and filled level. The height of each level is adjusted according to the potentiometers 284, 286, 288, individually, while as stated above the overall effect is adjusted according to the adjustment 298, that is, the potentiometer 298 is effective for controlling the full condition. At each of the levels, the relay 292 (16) is energized, according to the controls through the stepping switch at the various positions thereof.

Following the energization of the relay 292 (16) the contacts 292*b* (107) are closed, energizing the relay 304 (107) and the capacitor 307 (106) charges. There is a slight delay in energizing relay 304, and after it is energized the contacts 304*c* (108) are closed, energizing the relay 307 (108) also after a delay. The relay 304 (107) is held through holding contacts 304*b* (106), and contacts 234*g* (107).

After a delay, relay 234 (105) and relay 236 (106) de-energize, since the contacts 304*d* (104) close to normal position, then after the decay of the capacitor 235 (104), the relay 234 drops out. At this time also, the contacts 234*c* (114) open and then because of that condition, the relays 238 (113) and 240 (114) are de-energized and accordingly, the DC to the magnetic alignment coils 106, 108 (99) ceases. The contacts of the relay 238, 240 are found at (93) as described above.

Referring to specific order of steps, the contacts 304*e* (7) open before the contacts 234*i* (7) open, and during the time that the DC is impressed on the magnetic alignment coils 106, 108 (99), the contacts 234*i*, 304*e* (7) are closed, establishing a line to the SCR gate control 252 (82, 7). When the relay 306 (110) is energized because of the closing of contacts 304*e* (7), gate firing the SCR gate control 252 (82) is terminated, and that in turn cuts off the supply of the DC to the magnetic aligning assembly 106, 108 (99). At this time the contacts at (93) drop to a condition where the DC is terminated and the AC is introduced for demagnetizing.

Upon all control being cut off from the magnetic aligning assembly 106, 108 (99), and relay 304 (107) having been energized, its contacts 304*f* (42) are open and this interrupts circuit to the gate solenoid 138 (42) and the solenoid 301 (43) to the hopper. Also, contacts 302*b* (42) are open through terminals 348, 350 (50) under the control of the voltage drop in the adjustable resistor 300 (52, 88).

Referring again to the demagnetizing of the articles in the box, the boxes of course are held stationary by stopping the fill belt 46. This is controlled by the reactor assembly 256 (77). DC is impressed on the right hand coil through terminals 255, 262 (22). The initial level of demagnetization in the assembly 106, 108 (99) is set by the setting of the control 364 (22). At this time the relay 234 (105) will have dropped out, and its contacts 234*j* (22) are closed, and relay 304 will be energized, and its contacts 304*g* (22) are closed. At this point the AC passes the secondary 258S (77) of the saturable reactor, and AC is impressed on the magnetic aligning unit 106, 108 (99) for performing the demagnetizing step.

While the AC is diminishing in the secondary 258S, as described hereinabove, the AC is also diminishing in the magnetic aligning assembly 106, 108 (99). As an adjunct to this, and approximately simultaneously therewith, the following takes place; the relay 304 (107) de-energizes while the relay 306 (108) continues to energize through the capacitor 304A (108). Also at that time, the contacts 306*f* (20) are closed, and contacts 304*g* (20) are closed, and the index timer 216 (19) is re-cycled. The relay 212 (19) thereby energizes for the duration set on the timer 216 (19).

Referring to FIG. 18, the contacts 212*b* are closed upon energization of the relay 212 (19) as just referred to, the rotor 230 FIG. 18 is stepped, and while the relay 212 (19) is energized, the rotor advances one step and upon de-energization of relay 212 (19) the switch is advanced another step. The sequence described above proceeds until the second level (of the articles in the box) is reached as detected by the Hall sensor.

The motorized timer 207 (34, 35) remains running as long as the contacts in that conductor, 250*c*, 234*e*, 304*h*, remain closed, but if any of them are interrupted, the timer re-sets itself. If no re-setting takes place at the end of the selected cycle, which in the present instance may be 114 seconds, the motor actuates the cam actuated time switch 207A (103) de-energizing the relay 210, dropping the holding contacts 210*b* (4) and opening the main control circuit of the apparatus.

After a box is filled, it is carried away from the fill position, and a new box carried into that position. After all of the steps described above in connection with the step at the fill position are completed, the next step comes into play under the control of the stepping switch of FIG. 18, and particularly wafer 228D. At this wafer steps to position #6, there being two steps at each of the three fill levels, a circuit is established to the relay 306, shown in that figure, and (110). The terminals 309, 310 (110) are open, but in FIG. 23, wafer 228D establishes connection through these terminals when at position #6. It is in this position of the wafer that the relay 306 is put in circuit, or in other words, that wafer establishes a connection between those terminals. Upon energization of the relay 306 then, the following takes place; the contacts 306*d*, 306*e*, (57) are closed, driving the belt motor 52, and this carries the full box out of filled position, and of course carrying a new empty box into that position. The new box passes the PE cell means which energizes the index timer 216 (19) which energizes the relay 212 (19) and that relay steps the rotary switch (FIG. 18) and the operational steps described above are repeated.

Additionally, the energization of the relay 306 (110) closes the contacts 306*b* (128) energizing the relay 308 (126) again energizing the motor 39 (124) as described above and feeds an empty box on the conveyor 28 (FIG. 5). In this operation the relay 308 (126) closes its holding contact 308*b* (126), and until the normally closed contacts 306*c* (123) are closed, there is no circuit through the box feed motor, and that feed conveyor remains stationary. However, when the contacts 308*d* and 308*c* (123) are closed, or conditioned and when closed, the contacts later open, and a circuit is completed through the box feed motor 39. After the contacts 306*c* are closed, a circuit is established through the forward field of the motor and the feed conveyor starts to move and carry an empty box up to the filled conveyor 42.

We claim:

1. Apparatus for packaging magnetic articles, comprising, a fill conveyor for conveying moxes along a path and having a fill position in the path, means for intermittently moving the conveyor and stopping it with a box thereon in the fill position, means for placing a quantity of the articles in the box at fill position and including a spout for conducting them in a downwardly flowing stream, and further including means for reciprocating the spout along the path through the length of the box while placing the articles in the box, the apparatus including magnetizing/demagnetizing means for magnetizing and demagnetizing the articles in the box, the apparatus further including demagnetizing means being operative for forming a field extending throughout the range of reciprocation of the spout and thereby effective throughout that range for demagnetizing the articles in said downwardly flowing stream in the spout, the magnetizing/demagnetizing means being operative for magnetizing the articles in the box at the fill position to align them in predetermined position in the box, and the magnetizing/demagnetizing means being operative for demagnetizing the articles in the box at the fill position, after they have been so magnetized.

2. Apparatus according to claim 1 wherein, the demagnetizing means includes a circumferential coil with an opening therethrough elongated in the direction of reciprocation of the spout, and stationary in that direction, and the spout extends through that opening and thereby is positioned in the field of the coil.

3. Apparatus according to claim 1 wherein, the magnetizing/demagnetizing means includes a pair of magnet units on opposite sides of the fill position and adjustable toward and from each other to accommodate boxes at different thicknesses at that position, and operative for forming a magnetic field therebetween and through articles in a box in the fill position, and a transformer including a core with legs in operative engagement with said magnet units, but detachably so, enabling adjustment of the units, relative to the core, the means for demagnetizing the articles in the spout is mounted on and carried by one of said magnet units and thereby movable, with the magnet unit on which it is mounted, in direction longitudinally along the spout.

4. Apparatus according to claim 1 and including, a feed conveyor leading to the fill conveyor in direction transverse thereto, the fill conveyor having a guide rail therealong on the side thereof opposite to the feed conveyor, and having a switch in the guide rail in line with the feed conveyor, the feed conveyor being operative for conveying each box against the switch in its operation of conveying the boxes onto the fill conveyor, and the apparatus includes control means operatively associated with said switch, operative in response to actuation of the switch for stopping the feed conveyor and thereafter momentarily reversing it, to provide space effectively between the feed conveyor and the switch to enable the box to fall free onto the fill conveyor.

5. Apparatus according to claim 1 wherein, the apparatus includes control means for controlling the conveyor, the control means including a Hall generator means at the fill position and including a plurality of sensing units distributed along the fill position and thereby along a box when the latter is in that position, and throughout a range in that direction corresponding to a predetermined maximum length of box, and the units that are in register with the box, and hence the articles therein, in the case of any length within that range, are operative for sensing the quantity of articles in the box.

6. Apparatus according to claim 5 wherein, the sensing units in the Hall generator are in series arrangement, and thereby operative for producing cumulative voltage of the units for thereby producing control signals of correspondingly greater magnitude.

7. Apparatus according to claim 1 wherein, the reciprocating means includes a reciprocable table and a reversible electric motor for reciprocating it, control means associated with each direction of reciprocation of the table, operable for effecting reversing the table in response to movement of the table thereto, and means operably associated with each control means for applying a force in reversing direction on the motor and hence the table just before the motor stops in each direction of movement, whereby to gradually brake the motor and eliminate shock.

8. Apparatus according to claim 7 and including, means for applying a force for driving the table in the beginning of its movement after reversal, in each direction of movement, that progressively increases, and thereby gradually increases the speed of the table, in a continuation of movement without shock.

* * * * *